US006263583B1

(12) United States Patent
Mizuno

(10) Patent No.: US 6,263,583 B1
(45) Date of Patent: Jul. 24, 2001

(54) METHOD OF MEASURING EYEGLASS FRAME, AN APPARATUS FOR THE METHOD, AND EYEGLASS LENS GRINDING APPARATUS HAVING THE SAME

(75) Inventor: Toshiaki Mizuno, Aichi (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 09/126,769

(22) Filed: Jul. 31, 1998

(30) Foreign Application Priority Data

Jul. 31, 1997 (JP) ..... 9-220807

(51) Int. Cl.[7] ..... G01B 5/00

(52) U.S. Cl. ..... 33/28; 33/200; 33/507

(58) Field of Search ..... 33/28, 200, 507, 33/551, 553, 545, 546, 549, 554, 555; 451/5, 10, 43, 255, 256

(56) References Cited

U.S. PATENT DOCUMENTS

| | | | | |
|---|---|---|---|---|
| 4,724,617 | * | 2/1988 | Logan et al. | 33/28 |
| 5,138,770 | | 8/1992 | Matsuyama | 33/28 |
| 5,228,242 | | 7/1993 | Matsuyama | 51/165.74 |
| 5,333,412 | | 8/1994 | Matsuyama | 51/165.71 |
| 5,347,762 | | 9/1994 | Shibata et al. | 451/15 |
| 5,501,017 | * | 3/1996 | Suzuki | 33/200 |
| 5,775,973 | * | 7/1998 | Watanabe | 451/5 |

FOREIGN PATENT DOCUMENTS

| | | | | |
|---|---|---|---|---|
| 0190450 | * | 8/1986 | (EP) | 33/507 |
| 0 576 268 A1 | | 12/1993 | (EP) | G06F/15/24 |
| 0 666 139 A1 | | 9/1995 | (EP) | B24B/9/14 |
| 0 826 460 A1 | | 4/1998 | (EP) | B24B/9/14 |
| 63-028550 | | 6/1988 | (JP) | B24B/9/14 |
| 3-20603 | | 1/1991 | (JP) . | |
| 0020602 | * | 1/1991 | (JP) | 33/507 |
| 405212661 | * | 8/1993 | (JP) | 451/43 |

OTHER PUBLICATIONS

Optical Manufacturers Association, "The Boxing System of Lens and Frame Measurement", Jul.–1961,pp. 1–9.*

* cited by examiner

*Primary Examiner*—Diego Gutierrez
*Assistant Examiner*—Lydia M. De Jesús
(74) *Attorney, Agent, or Firm*—Sughrue, Mion, Zinn, Macpeak & Seas, PLLC

(57) ABSTRACT

The accuracy of the axial degree of a lens in an eyeglass production is improved. In an eyeglass frame measuring apparatus, first and second frame data on the eyeglass frame consisting of first and second frames are entered. The entered first frame data are inverted to obtain a third frame data. On the basis of the third frame data and the entered second frame data, an amount of deviation of the second frame data with respect to the third frame data in a rotation direction is obtained. An eyeglass lens is processed on the basis of the rotation deviation amount and the third frame data.

7 Claims, 7 Drawing Sheets

METHOD OF MEASURING EYEGLASS FRAME, AN APPARATUS FOR THE METHOD, AND EYEGLASS LENS GRINDING APPARATUS HAVING THE SAME

BACKGROUND OF THE INVENTION

The present invention relates to a method of measuring an eyeglass frame, and an eyeglass frame measuring apparatus which are used for grinding an eyeglass lens on the basis of measurement data of an eyeglass frame, and also to an eyeglass lens grinding apparatus.

An apparatus is known which measures the frame configuration of an eyeglass frame and grinds an eyeglass lens on the basis of data of the measurement. In such a process, a method in which the process is performed on the basis of frame configuration data for each of the right and left eyes may be employed. In the case where right and left frame configurations are different from each other, when lenses are processed so as to respectively conform to the configurations, however, the resulting eyeglass may look strange. Therefore, such a process is usually performed by using data in which data for one of the right and left configurations is set as a reference and data for the other configuration is obtained by inverting (mirror-inverting) the reference data.

Usually, the right and left frame configurations of an eyeglass frame are substantially bilaterally symmetrical with each other. However, it is not rare that the positional relationship between the right and left frames are slightly relatively rotated as shown in FIG. 8 due to a problem in production. This easily occurs particularly in an eyeglass frame such as a metal frame which is produced by separately producing right and left frames and then bonding the frames together via a bridge. Furthermore, an eyeglass frame may be deformed during transportation and handling after production. Therefore, in a process using a mirror-inverted data, even when the one lens is processed on the basis of the reference data at a correct axial degree (characteristic), the axial degree of the other lens contains an error, thereby causing a problem in that the axis degree of an eyeglass lens mounted to the frame fails to conform to a predetermined one.

SUMMARY OF THE INVENTION

In view of the problem discussed above, it is an object of the invention to provide a method and an apparatus in which the axial degree or axial characteristic in production of an eyeglass can be improved.

(1) An eyeglass frame measuring apparatus for measuring an eyeglass frame, the apparatus comprising:

frame data input means for entering first and second frame data on the eyeglass frame consisting of first and second frames;

frame data inverting means for inverting the entered first frame data to obtain a third frame data; and rotational deviation computing means for, on the basis of the third frame data and the second frame data entered through the frame data input means, obtaining an amount of deviation of the second frame data with respect to the third frame data in a rotation direction.

(2) An eyeglass frame measuring apparatus according to (1), further comprising correcting means for correcting the third frame data on the basis of the rotational deviation amount obtained by the rotational deviation computing means, to obtain a fourth frame data.

(3) An eyeglass frame measuring apparatus according to (1), wherein the rotational deviation computing means obtains the deviation amount in the rotation direction when a difference in radius vector length between the second and third frame data corresponding to a radius vector angle is minimum.

(4) An eyeglass frame measuring apparatus according to (1), wherein the rotational deviation computing means obtains the deviation amount in the rotation direction from feature of frame configurations represented by the second and third frame data.

(5) An eyeglass frame measuring apparatus according to (1), further comprising peripheral length calculating means for obtaining peripheral lengths of the two frames on the basis of the first and second frame data.

(6) An eyeglass lens grinding apparatus for grinding a pair of eyeglass lenses such that the eyeglass lenses conform to the configuration of an eyeglass frame, the apparatus comprising:

frame data input means for entering first and second frame data on the eyeglass frame consisting of first and second frames;

frame data inverting means for inverting the entered first frame data to obtain a third frame data;

rotational deviation computing means for, on the basis of the third frame data and the second frame data entered through the frame data input means, obtaining an amount of deviation of the second frame data with respect to the third frame data in a rotation direction;

correcting means for correcting the third frame data on the basis of the rotational deviation amount obtained by the rotational deviation computing means, to obtain a fourth frame data;

layout means for providing a layout of the eyeglass lenses with respect to the first and fourth frame data;

bevel position determining means for determining a position of a bevel in a thickness direction on an edge of each of the eyeglass lenses for which the layout is provided by the layout means; and controlling means for grinding each of the eyeglass lenses on the basis of the layout provided by the layout means and the bevel position provided by the bevel position determining means.

(7) An eyeglass lens grinding apparatus according to (6), wherein the controlling means comprises:

peripheral length calculating means for obtaining first and second peripheral lengths on the basis of the first and second frame data; and computing means for obtaining process data from the first frame data so as to be substantially coincident with the first peripheral length, and process data from the fourth frame data so as to be substantially coincident with the second peripheral length.

(8) A method of measuring an eyeglass frame, the method comprising:

a first step of measuring first and second frames of the eyeglass frame to obtain first and second frame data, respectively;

a second step of inverting the first frame data to obtain a third frame data; and a third step of, on the basis of the third frame data and the second frame data, obtaining an amount of deviation of the second frame data with respect to the third frame data in a rotation direction.

(9) A method of measuring an eyeglass frame according to (8), wherein the first and third frame data and the rotational deviation amount obtained in the third step are used as frame data for an eyeglass lens grinding process.

(10) A method of measuring an eyeglass frame according to (8), further comprising:

a fourth step of correcting the third frame data on the basis of the rotational deviation amount, to obtain a fourth frame data.

(11) An eyeglass frame and template configuration measuring device comprising:

a configuration measuring section which measures configurations of two frames of an eyeglass to obtain first and second measured frame configuration data;

a program memory which stores a predetermined program therein;

a tracer arithmetic control circuit which, in accordance with the program: converts the first and second configuration data into third and fourth target lens configuration data with respect to boxing centers, respectively; mirror-inverts the third configuration data to obtain fifth mirror-inverted configuration data; and compares the fourth configuration data with the fifth configuration data with respect to a corresponding boxing center to obtain an axial characteristic correction angle; and a trace data memory which stores the third configuration data and the axial characteristic correction angle therein.

(12) An eyeglass frame and template configuration measuring device according to (11), wherein the tracer arithmetic control circuit calculates peripheral length data based on the first and second configuration data, respectively, and the trace data memory stores the peripheral length data therein.

The present disclosure-relates to the subject matter contained in Japanese patent application No. Hei. 9-220807 (filed on Jul. 31, 1997) which is expressly incorporated herein by reference in its entirety.

DETAILED DESCRIPTION OF THE PREFERRED EMBODIMENTS

Embodiments of the invention will now be described in detail with reference to the accompanying drawings.

Figure 1:
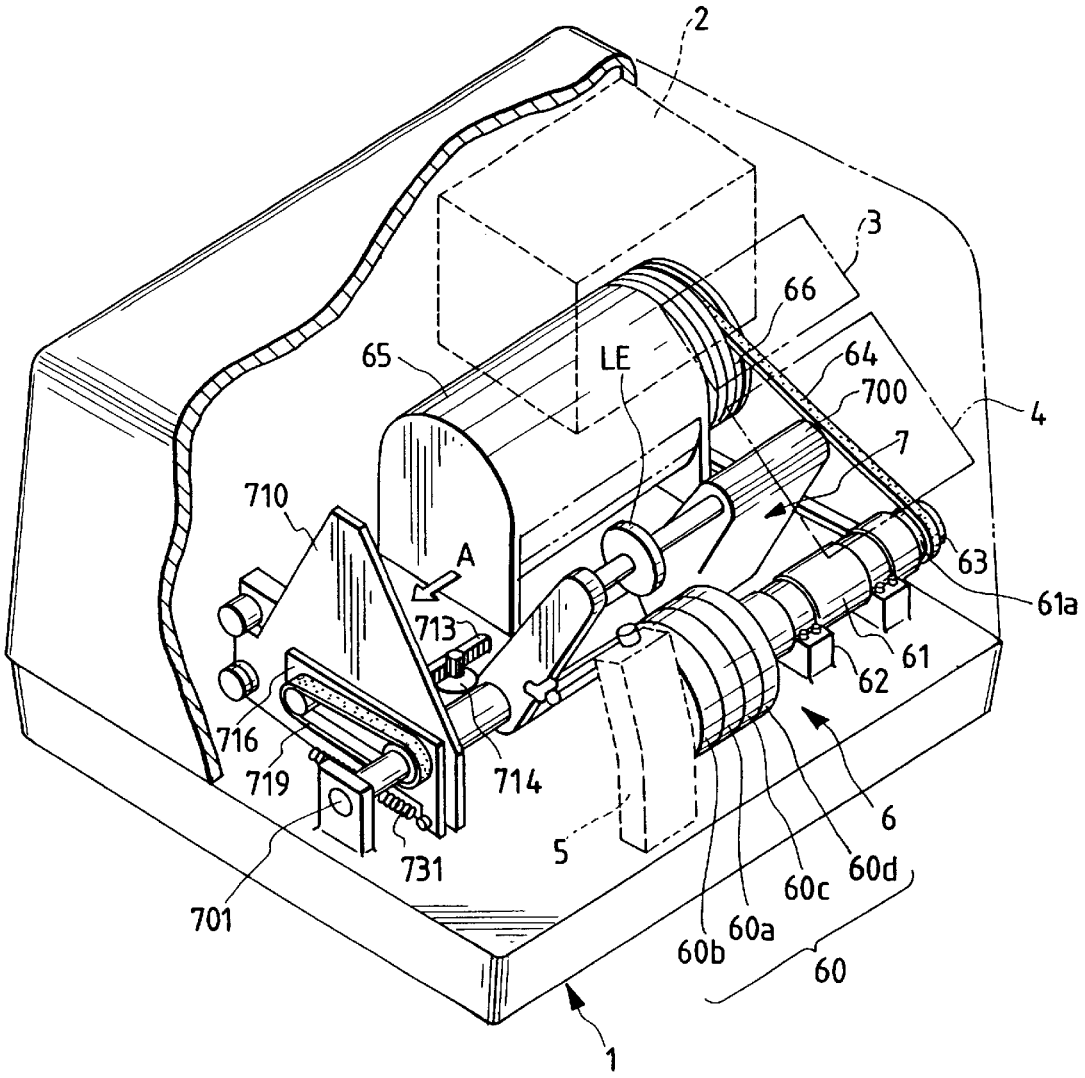
FIG. 1 is a perspective view showing the general configuration of the lens grinding apparatus of the invention.

FIG. 1 is a perspective view showing the general layout of the eyeglass lens grinding apparatus of the invention. The reference numeral 1 designates a base, on which the components of the apparatus are arranged. The numeral 2 designates an eyeglass frame and template configuration measuring device, which is incorporated in the upper section of the grinding apparatus to obtain three-dimensional configuration data on the geometries of the eyeglass frame and the template. Arranged in front of the measuring device 2 are a display section 3 which displays the results of measurements, arithmetic operations, etc. in the form of either characters or graphics, and an input section 4 for entering data or feeding commands to the apparatus. Provided in the front section of the apparatus is a lens configuration measuring section 5 for measuring the configuration (edge thickness) of a lens LE to be processed.

The reference numeral 6 designates a lens grinding section, where an abrasive wheel group 60 made up of a rough abrasive wheel 60*a* for use on glass lenses, a rough abrasive wheel 60*b* for use on plastic lenses, a finishing abrasive wheel 60*c* for bevel (tapered edge) and plane processing operations and so on is mounted on a rotating shaft 61*a* of a spindle unit 61, which is attached to the base 1. The reference numeral 65 designates an AC motor, the rotational torque of which is transmitted through a pulley 66, a belt 64 and a pulley 63 mounted on the rotating shaft 61*a* to the abrasive wheel group 60 to rotate the same. Shown by 7 is a carriage section and 700 is a carriage.

Layout of the Major Component

Next, the layout of the major components of the apparatus will be described.

(A) Carriage section

Figure 2:
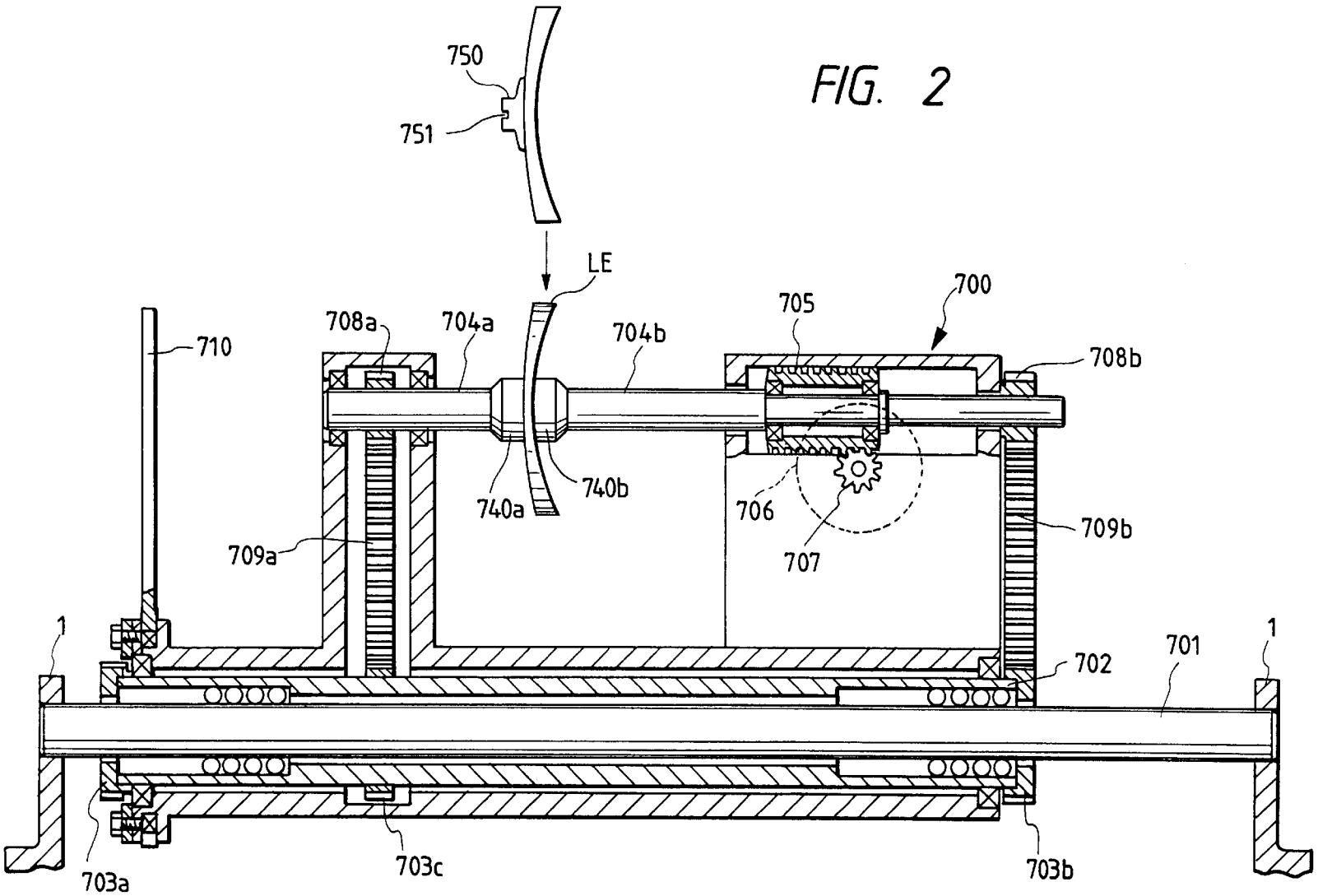
FIG. 2 is a sectional view of a carriage.
Figure 3:
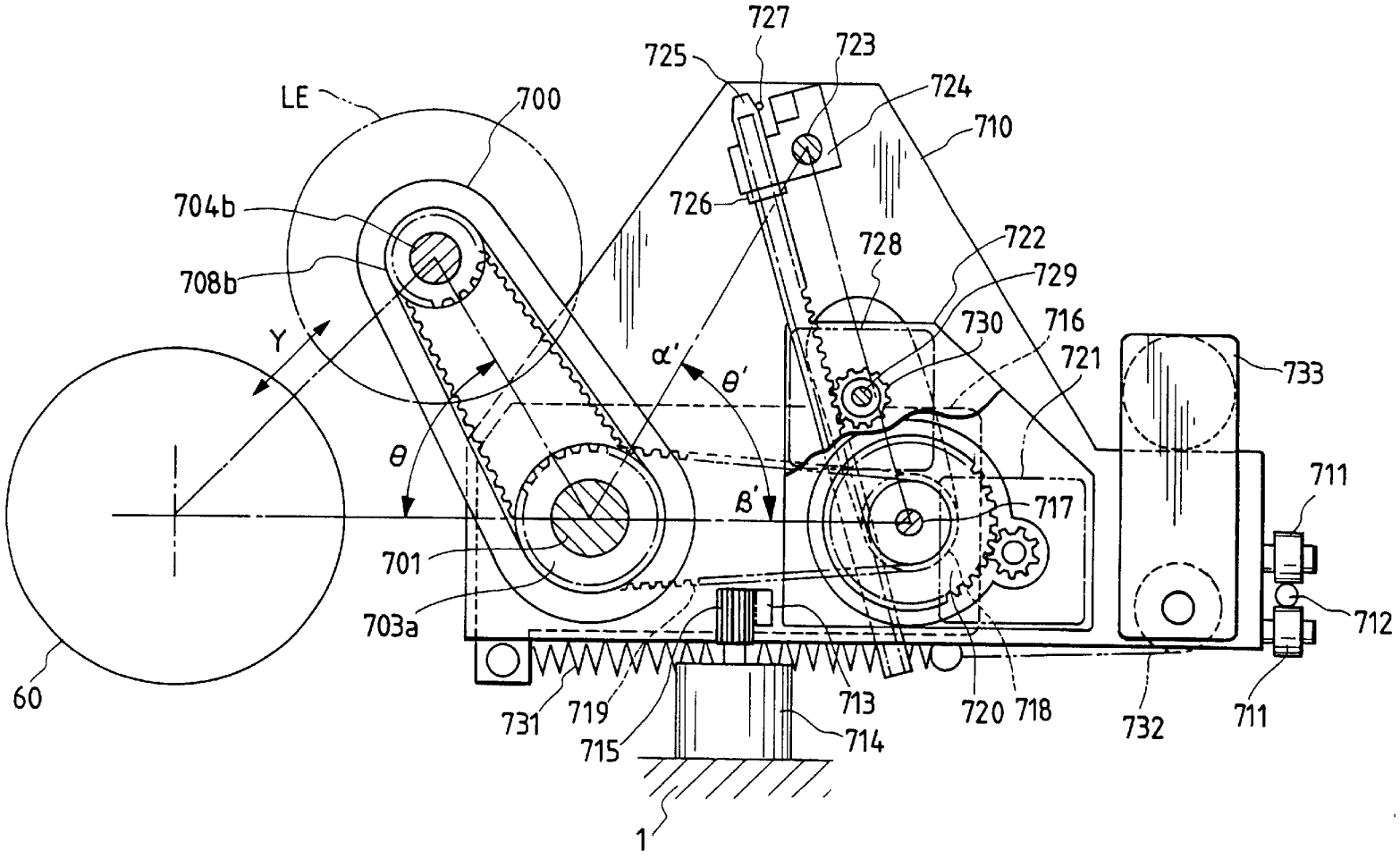
FIG. 3 is a view showing a carriage driving mechanism as seen in the direction of arrow A of FIG. 1.

The construction of the carriage section will now be described with reference to FIGS. 1 to 3. FIG. 2 is a cross-sectional view of the carriage, and FIG. 3 is a diagram showing a drive mechanism for the carriage, as viewed in the direction of arrow A in FIG. 1.

A shaft 701 is secured on the base 1 and a carriage shaft 702 is rotatably and slidably supported on the shaft 701; the carriage 700 is pivotally supported on the carriage shaft 702. Lens rotating shafts 704*a* and 704*b* are coaxially and rotatably supported on the carriage 700, extending parallel to the shaft 701. The lens rotating shaft 704*b* is rotatably supported in a rack 705, which is movable in the axial direction by means of a pinion 707 fixed on the rotational shaft of a motor 706. A cup receptor 740*a* is mounted on the lens rotating shaft 704*a* for receiving a base of a fixing cup 750 fixed to the lens LE to be processed, and a lens contactor 740*b* is attached to the lens rotating shaft 704*b*. With this arrangement, the lens rotating shafts 704*a* and 704*b* can hold the lens LE to be processed.

A drive plate 716 is securely fixed at the left end of the carriage 700 and a rotational shaft 717 is rotatably provided on the drive plate 716, extending parallel to the shaft 701. A pulse motor 721 is fixed to the drive plate 716 by means of a block 722. The rotational torque of the pulse motor 721 is transmitted through a gear 720 attached to the right end of the rotating shaft 717, a pulley 718 attached to the left end of the rotating shaft 717, a timing belt 719 and a pulley 703*a* to the shaft 702. The rotational torque thus transmitted to the shaft 702 is further transmitted through a timing belts 709*a*, 709*b*, pulleys 703*b*, 703*c*, 708*a*, and 708*b* to the lens rotating shafts 704*a* and 704*b* so that the lens rotating shafts 704*a* and 704*b* rotate in synchronism.

An intermediate plate 710 has a rack 713 which meshes with a pinion 715 attached to the rotational shaft of a carriage moving motor 714, and the rotation of the motor 714 causes the carriage 700 to move in an axial direction of the shaft 701.

The carriage 700 is pivotally moved by means of a pulse motor 728. The pulse motor 728 is secured to a block 722 in such a way that a round rack 725 meshes with a pinion 730 secured to the rotational shaft 729 of the pulse motor 728. The round rack 725 extends parallel to the shortest line segment connecting the axis of the rotational shaft 717 and that of the shaft 723 secured to the intermediate plate 710; in addition, the round rack 725 is held to be slidable with a certain degree of freedom between a correction block 724 which is rotatably fixed on the shaft 723 and the block 722. A stopper 726 is fixed on the round rack 725 so that it is capable of sliding only downward from the position of contact with the correction block 724. With this arrangement, the axis-to-axis distance r' between the rotational shaft 717 and the shaft 723 can be controlled in accordance with the rotation of the pulse motor 728 and it is also possible to control the axis-to-axis distance r between the abrasive wheel rotating shaft 61*a* and each of the lens rotating shafts 704*a* and 704*b* since r has a linear correlationship with r'.

A sensor 727 is installed on an intermediate plate 710 so as to detect the contact condition between the stopper 726 and the correction block 724. Therefore, the grinding condition of the lens LE can be checked. A hook of a spring 731 is hung on the drive plate 716, and a wire 732 is hung on a hook on the other side of the spring 731. A drum is attached on a rotational shaft of a motor 733 secured on the intermediate plate 710, so that the wire 732 can be wound on the drum. Thus, the grinding pressure of the abrasive wheel group 60 for the lens LE can be changed.

The arrangement of the carriage section of the present invention is basically the same as that described in the commonly assigned U.S. Pat. No. 5,347,762, to which the reference should be made.

(B) Eyeglass Frame and Template Configuration Measuring Device

Figure 4:
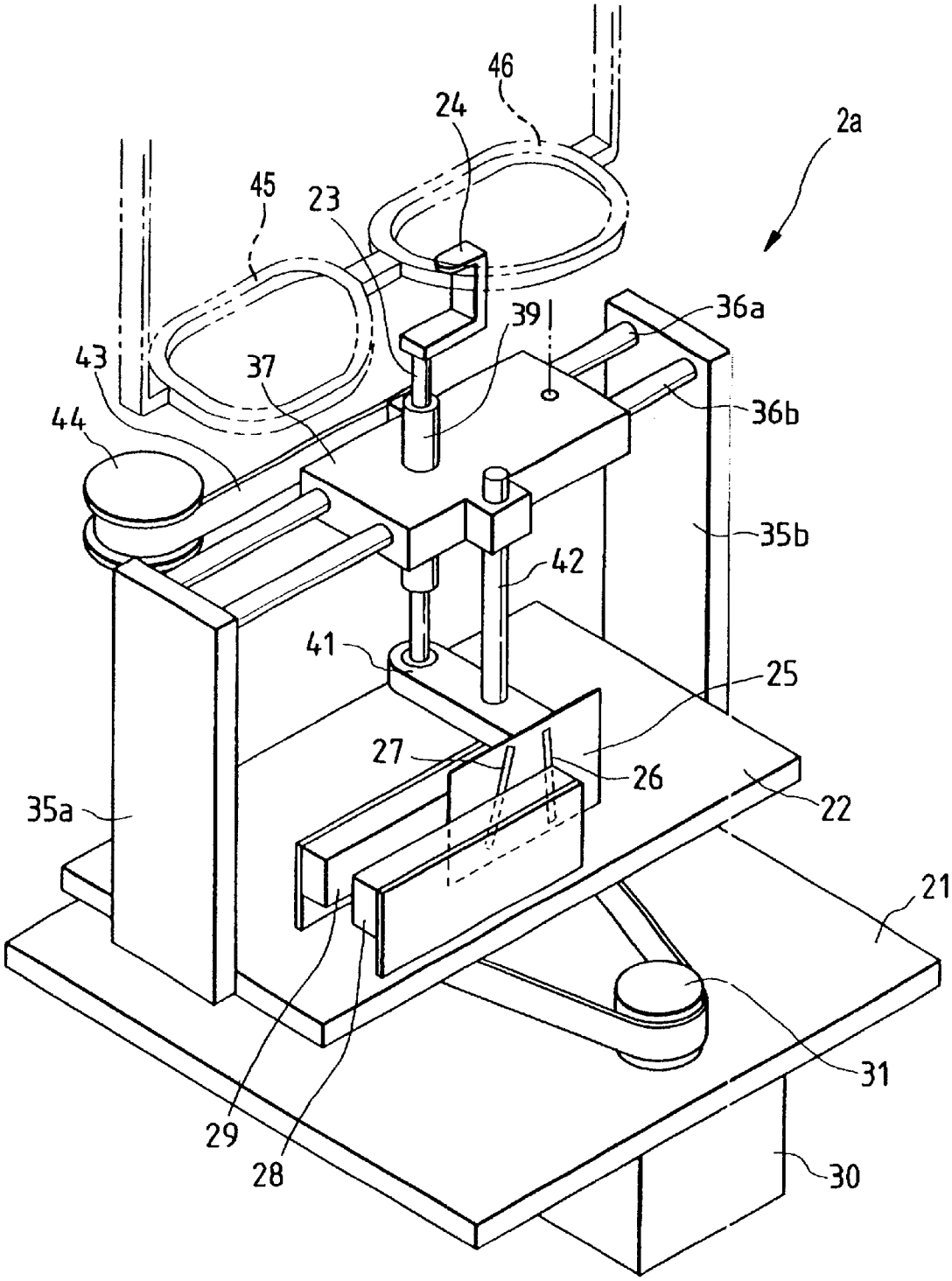
FIG. 4 is a perspective view of an eyeglass frame and template configuration measuring device.

FIG. 4 is a perspective view of a configuration measuring section 2*a* of the eyeglass frame and template configuration measuring device 2. The configuration measuring section 2*a* comprises a moving base 21 which is movable in a horizontal direction, a rotating base 22 which is rotatably and axially supported on the moving base 21 and which is rotated by a pulse motor 30, a moving block 37 which is movable along two rails 36*a* and 36*b* supported on retainer plates 35*a* and 35*b* provided vertically on the rotating base 22, a gage head shaft 23 which is passed through the moving block 37 in such a way that it is capable of both rotation and vertical movements, a gage head 24 attached to the top end of the gage head shaft 23 such that its distal end is located on the central axis of the shaft 23, an arm 41 which is rotatably attached to the bottom end of the shaft 23 and is fixed to a pin 42 which extends from the moving block 37 vertically, a light shielding plate 25 which is attached to the distal end of the arm 41 and which has a vertical slit 26 and a 45° inclined slit 27, a combination of a light-emitting diode 28 and a linear image sensor 29 which are attached to the rotating base 22 to interpose the light shielding plate 25 therebetween, and a constant-torque spring 43 which is attached to a drum 44 rotationally and axially supported on the rotating base 22 and which normally pulls the moving block 37 toward the distal end of the head gage 24.

The configuration measuring section 2*a* having the construction just described above measures the configuration of the eyeglass frame in the following manner. First, the eyeglass frame is fixed in a frame holding portion (not shown but see, for example, U.S. Pat. No. 5,347,762) and the distal end of the gage head 24 is brought into contact with the bottom of the groove formed in the inner surface of the eyeglass frame. Subsequently, the pulse motor 30 is allowed to rotate in response to a predetermined unit number of rotation pulses. As a result, the gage head shaft 23 which is integral with the gage head 24 moves along the rails 36*a* and 36*b* in accordance with the radius vector of the frame and also moves vertically in accordance with the curved profile of the frame. In response to these movements of the gage head shaft 23, the light shielding plate 25 moves both vertically and horizontally between the LED 28 and the linear image sensor 29 such as to block the light from the LED 28. The light passing through the slits 26 and 27 in the light shielding plate 25 reaches the light-receiving part of the linear image sensor 29 and the amount of movement of the light shielding plate 25 is read. The position of slit 26 is read as the radius vector r of the eyeglass frame and the positional difference between the slits 26 and 27 is read as the height information z of the same frame. By performing this measurement at N points, the configuration of the eyeglass frame is analyzed as (rn, θn, zn) (n=1, 2, . . . , N). The eyeglass frame and template configuration measuring device 2 under consideration is basically the same as what is described in commonly assigned U.S. Pat. No. 5,138,770, to which reference should be made. The correction for warp on the eyeglass frame may be carried out at this time, or otherwise may be carried out later.

(C) Electronic Control System for the Apparatus

Figure 5:
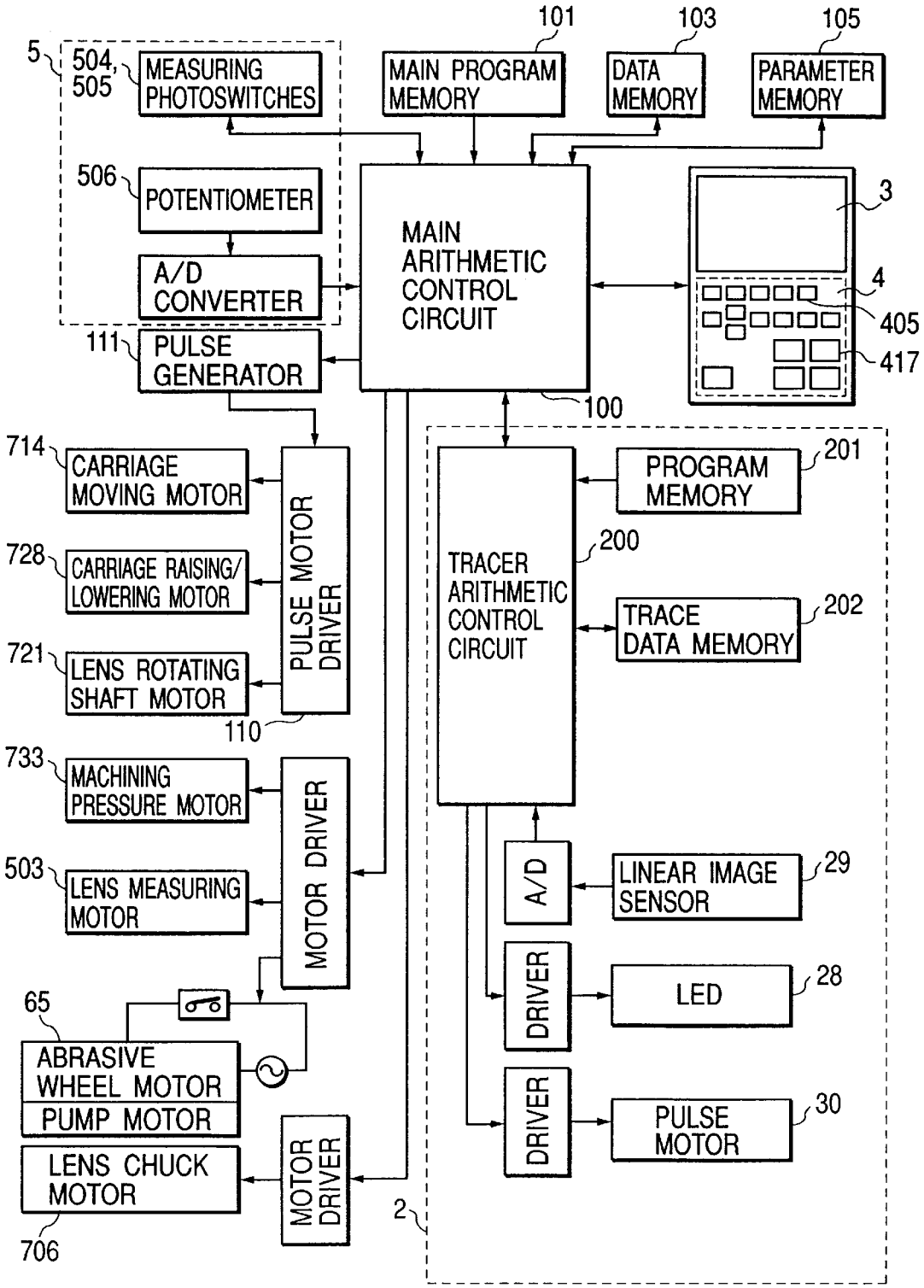
FIG. 5 is a block diagram showing essential parts of an electric control system of the apparatus.

FIG. 5 shows the essential part of a block diagram of the electronic control system for the eyeglass lens grinding apparatus of the invention. A main arithmetic control circuit 100 is typically formed of a microprocessor and controlled by a sequence program stored in a main program memory 101. The main arithmetic control circuit 100 can exchange data with IC cards, eye examination devices and so forth via a serial communication port 102. The main arithmetic control circuit 100 also performs data exchange and communication with a tracer arithmetic control circuit 200 of the eyeglass frame and template configuration measurement device 2. Data on the eyeglass frame configuration are stored in a data memory 103.

The display section 3, the input section 4 and the lens configuration measuring section 5 are connected to the main arithmetic control circuit 100. The processing data of lens which have been obtained by arithmetic operations in the main arithmetic control circuit 100 are stored in the data memory 103. The carriage moving motor 714, as well as the pulse motors 728 and 721 are connected to the main arithmetic control circuit 100 via a pulse motor driver 110 and a pulse generator 111. The pulse generator 111 receives commands from the main arithmetic control circuit 100 and determines how many pulses are to be supplied at what frequency in Hz to the respective pulse motors to control operation of motors.

The operation of the thus configured apparatus will be described.

Figure 6:
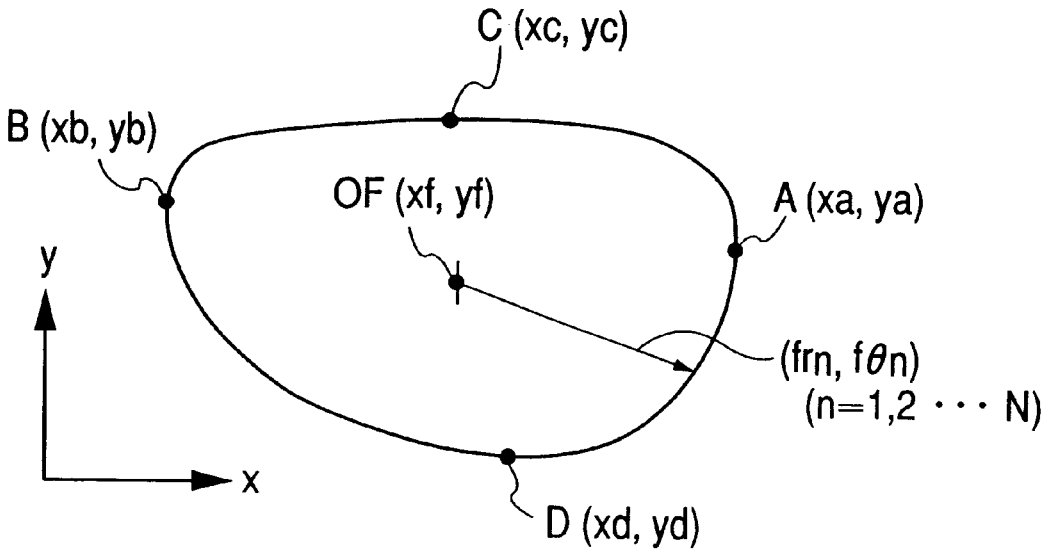
FIG. 6 is a diagram illustrating a manner of obtaining boxing center coordinates of a lens frame.

Each of the configurations (hereinafter, referred to also as target lens configurations) of the right (45, FIG. 4) and left (46, FIG. 4) frames of an eyeglass is measured as described above by using the eyeglass frame and template configuration measuring device 2, to obtain measurement data ($r_n$, $\theta_n$, $z_n$) (n=1, 2, . . . , N) for the right and left frame configuration. From x and y components obtained by subjecting the measurement data to polar-orthogonal coordinate-transformation, the arithmetic control circuit 200 selects a measured point A (xa, ya) which has the maximum value in the x direction as shown in FIG. 6, a measured point B (xb, yb) which has the minimum value in the x direction, a measured point C (xc, yc) which has the maximum value in the y direction, and a measured point D (xd,yd) which has the minimum value in the y direction, and obtains the coordinates (xf, yf) of the boxing center (geometrical center) OF of the lens frame as:

$$(xf, yf)=((xa+xb)/2, (yc+yd)/2).$$

The measured data are converted into polar coordinates having the OF (xf, yf) as the center, thereby obtaining data ($fr_n$, $f\theta_n$) (n=1, 2, . . . , N) on the target lens configuration with respect to the boxing center OF. The above is performed on each of the right and left frames to obtain the right target lens configuration data ($Rfr_n$, $Rf\theta_n$) and the left target lens configuration data ($Lfr_n$, $Lf\theta_n$). In the embodiment, the right target lens configuration data is used as the reference which serves as the base of the process, and ($L'fr_n$, $L'f\theta_n$) which is obtained by inverting (mirror-inverting) the reference data is used as the left target lens configuration data.

Next, the mirror-inverted data is slightly rotated from this state in a clockwise direction and a counterclockwise direction to seek a rotational position where the configuration represented by the mirror-inverted data is the most coincident with the configuration represented by the left target lens configuration data, and a deviation amount in the rotation direction from the original state to that position is obtained. For example, this amount is obtained in the following manner.

Figure 7:
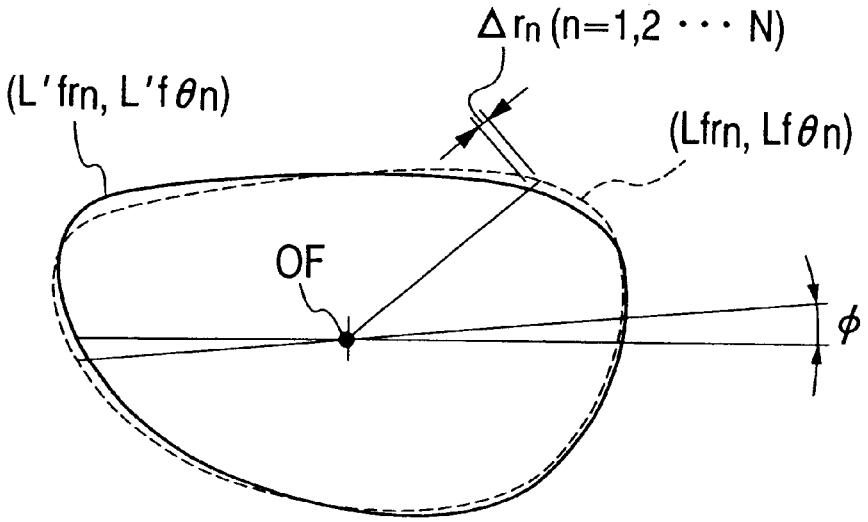
FIG. 7 is a diagram illustrating a method of obtaining a deviation amount in the rotation direction in the case where a mirror-inverted data is the most coincident with a lens shape data in configuration.

The measured left target lens configuration data is compared with the mirror-inverted data, about the boxing center, and a radius difference $\Delta r_n$ (see FIG. 7) at each angle in the polar coordinates is obtained in the entire peripheral length. The obtained differences are squared and their mean error Arav is obtained as follows:

$$\Delta rav=\{(\Delta r_1)^2+(\Delta r_2)^2+(\Delta r_3)^2+ \ldots +(\Delta r_N)^2\}/N \qquad \text{(Ex.1)}$$

Next, the mirror-inverted data is rotated about the boxing center OF by an arbitrary minute angle, and then the same calculation as the above is conducted. This rotation is performed in a clockwise direction and a counterclockwise direction in a predetermined range (for example, a range of ±5°), and the rotation amount in the case where Δrav is minimum is obtained. This rotation amount is the axial degree correction angle (ϕ) for the mirror-inverted data in processing the lens (i.e. the left lens in this case).

The axial degree correction angle (ϕ) may be obtained by another method, or from a feature of the target lens configuration. For example, the angles of plural points of inflection in the configuration of the target lens configuration data are considered, the angles are compared with those of plural points of inflection in the configuration of the mirror-inverted data, and a rotation angle at which the highest coincidence between the angles of corresponding points of inflection is attained is obtained (the mirror-inverted data is rotated about the boxing center OF by an arbitrary minute angle as described above, and the angle difference between corresponding points of inflection is made minimum).

The arithmetic control circuit 200 calculates distances among measurement data ($r_n$, $\theta_n$, $z_n$) (n=1, 2, . . . , N) on the frame configuration, and sums the distances to approximately obtain a peripheral length data of each of the right and left target lens configuration data.

The sets of the thus obtained information (the target lens configuration data of the reference side, the axial degree correction angle of the mirror-inverted side, and the peripheral length data of both the target lens configurations) are stored in the trace data memory 202. When the next-data switch 417 is depressed, the data are transferred to the main arithmetic control circuit 100 to be stored in the data memory 103.

Next, the process to be performed on the left side in which the mirror-inverted data is used will be described. The process on the left lens is selected by depressing the R/L switch 405. The main arithmetic control circuit 100 corrects the data ($L'fr_n$, $L'f\theta_n$) which is obtained by mirror-inverting the reference data or the right target lens configuration data, by the axial degree correction angle (ϕ) to obtain a new target lens configuration data ($L'fr_n'$, $L'f\theta_n'$) (this correction may include an operation of simply shifting the mirror-inverted data by the axial degree correction angle (ϕ)). The left target lens configuration based on the data is displayed on the screen of the display section 3, and the entering of process conditions is enabled. Through the input section 4, the optician inputs layout data such as the PD value of the user, the FPD value, and the height of the optical center, and process conditions such as the material of the lens to be processed, the material of the frame, and the process mode.

The optician attaches the fixing cup 750 shown in FIG. 2 to the left lens to be processed, and the fixing cup 750 is then mounted on the cup receptor 740*a*. The lens LE with the fixing cup 750 is chucked by the lens rotating shafts 704*a* and 704*b*. When the lens to be processed has axial characteristic such as an astigmatic (cylindrical) axis, the fixing cup 750 is fixed to the lens to be processed so that the axial direction of the lens corresponds to a key groove 751 formed in the base portion of the fixing cup 750, and the fixing cup 750 is then mounted on the cup receptor 740*a* so that the key groove 751 of the fixing cup 750 is fitted onto a key formed in the cup receptor 740*a*. As a result, the apparatus can manage the relationship between the rotation angle of the lens rotating shaft and the axial direction of the lens to be processed.

When preparation for the process is completed, the START switch is depressed to start the operation of the apparatus. In response to START signal, the apparatus performs a process correction calculation for calculating the axis-to-axis distance between the rotation center of the lens and that of the grinding wheels for the process. Thereafter, the lens configuration measuring section 5 is operated so as to measure the lens configuration, and the bevel calculation is performed on the basis of information indicative of the obtained lens configuration (the edge thickness). The size correction calculation is performed so that the peripheral length of the bevel curve locus obtained by the bevel calculation substantially coincides with the peripheral length data of the target lens configuration, thereby obtaining process information. For the process correction calculation, the structure and measurement operation of the lens configuration measuring section, and the peripheral length correction, see, for example, U.S. Pat. No. 5,347,762.

When the process information is obtained, the process is executed by controlling the operation of the carriage section 7 in accordance with the process sequence. First, the carriage 700 is moved so that the chucked lens to be processed is positioned to face the rough abrasive wheel corresponding to the designation of the material of the lens to be processed. The operations of the motors are controlled so as to process the lens to be processed on the basis of the process information for the rough process. Thereafter, the lens to be processed is separated from the rough abrasive wheel, and then positioned to face the bevel groove of the finishing abrasive wheel 60*c*. The operations of the motors are controlled so as to perform the bevel finishing process on the basis of the process information for the bevel process.

Figure 8:
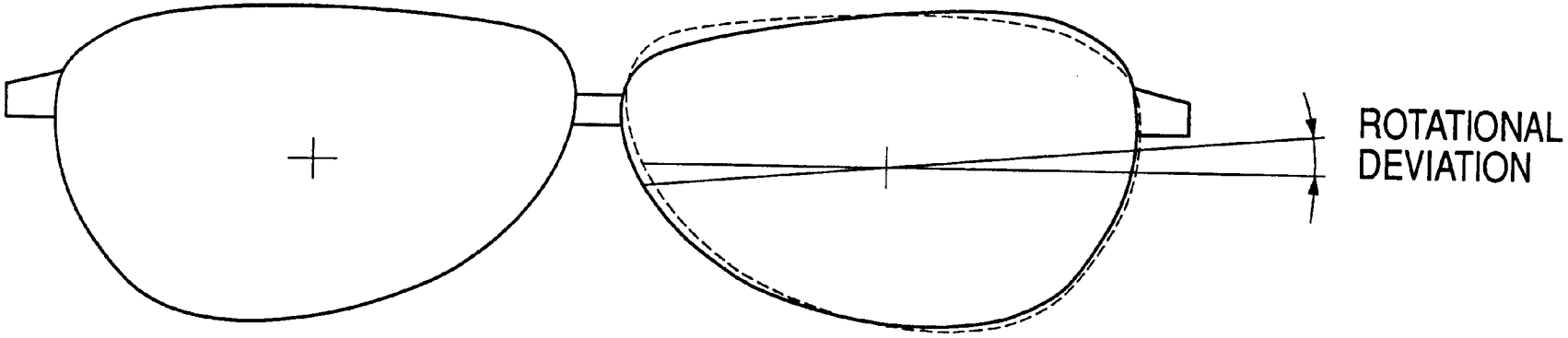
FIG. 8 is a diagram showing a case where there is deviation in a rotation direction in positional relationship between right and left frames.

According to this process, even when a lens having axial characteristic such as an astigmatic (cylindrical) axis, a progressive lens, or a bifocal lens is to be processed and deviation in the rotation direction exists in the positional relationship between the right and left frames as shown in FIG. 8, the optician can produce a satisfactory eyeglass lens and thus eyeglass without paying particular attention since the accuracy of the axial characteristic of the eyeglass lens when the lens is mounted to the eyeglass frame is high.

In the above, the embodiment in which the apparatus has the eyeglass frame and template configuration measuring device 2 has been described. Alternatively, the eyeglass frame and template configuration measuring device 2 may be separately disposed, or the process may be performed by means of data communication through a communication network. In the eyeglass frame and template configuration measuring device 2, the target lens configuration data of the reference side, and the mirror-inverted lens configuration data of the opposite side which is corrected by the axial degree correction angle (φ) are obtained, and both the target lens configuration data may be subjected to data-transmission to the processing apparatus. In the case of the communication process, the transmission of both the right and left target lens configuration data may be sometimes disadvantageous in communication time and cost. In such a case, the transmission of the target lens configuration data may be performed only for the data of the reference side, and the data may be transmitted together with the peripheral length correction data and the axial degree correction data. In the processing apparatus, the target lens configuration data of the reference side is mirror-inverted, and the process is then performed for the reference side and the opposite side based on the target lens configuration data, the inverted data and axial degree correction data.

As described above, according to the invention, even when there is rotational deviation between right and left frames of an eyeglass, a process can be performed while correcting the axial degree or characteristic of a lens which is to be processed and mounted to a frame. Therefore, the accuracy of the axial degree of a lens in an eyeglass production can be improved.

What is claimed is:

1. An eyeglass frame measuring apparatus for measuring a configuration of an eyeglass frame for the purpose of grinding eyeglass lenses, said apparatus comprising:

frame configuration measuring means for measuring three-dimensional configurations of right and left lens frames of the eyeglass frame to obtain first and second target lens shape data, respectively;

first computing means for, on the basis of comparison of data obtained by laterally inverting the first target lens shape data with the second target lens shape data, obtaining an amount of rotational deviation of the second target lens shape data with respect to the data obtained by inverting the first target lens shape data;

second computing means for, on the basis of the three-dimensional configurations of the right and left lens frames measured by the frame configuration measuring means, obtaining respective peripheral lengths of the right and left lens frames; and data sending means for sending one of the first target lens shape data and the second target lens shape data, the amount of rotational deviation, and the peripheral lengths of the right and left lens frame to an eyeglass lens processing apparatus.

2. An eyeglass frame measuring apparatus according to claim 1, wherein said first computing means obtains the amount of rotational deviation so that a difference in radius vector length between the data obtained by inverting the first target lens shape data and second target lens shape data corresponding to a radius vector angle is minimum.

3. An eyeglass frame measuring apparatus according to claim 1, wherein said first computing means obtains the amount of rotational deviation from feature of frame configurations represented respectively by the data obtained by inverting the first target lens shape data and the second target lens shape data.

4. An eyeglass lens grinding apparatus for grinding eyeglass lenses, said apparatus comprising:

a frame configuration measuring unit including:

frame configuration measuring means for measuring three-dimensional configurations of right and left lens frames of an eyeglass frame to obtain first and second target lens shape data, respectively;

first computing means for, on the basis of comparison of data obtained by laterally inverting the first target lens shape data with the second target lens shape data, obtaining an amount of rotational deviation of the second target lens shape data with respect to the data obtained by inverting the first target lens shape data;

second computing means for, on the basis of the three-dimensional configurations of the right and left lens frames measured by the frame configuration measuring means, obtaining respective peripheral lengths of the right and left lens frames; and data sending means for sending the first target lens shape data, the amount of rotational deviation, and the peripheral lengths of the right and left lens frame as configurational data of the eyeglass frame; and a lens grinding unit including third computing means for, on the basis of data obtained by inverting the thus send first target lens shape data and the thus sent amount of rotational deviation, obtaining third target lens shape data, wherein the lens grinding unit uses the third target lens shape data in place of the second target lens shape data.

5. A method of obtaining target lens shape data by measuring a configuration of an eyeglass frame for the purpose of grinding eyeglass lenses, said method comprising:

a first step of measuring three dimensional configurations of right and left lens frames of the eyeglass frame to obtain first and second target lens shape data, respectively;

a second step of obtaining an amount of rotational deviation of the second target lens shape data with respect to data obtained by laterally inverting the first target lens shape data on the basis of comparison of the data obtained by inverting the first target lens shape data with the second target lens shape data;

a third step of sending the first target lens shape data, and the amount of rotational deviation to a computing and controlling device in an eyeglass lens grinding apparatus; and a fourth step of correcting data obtained by inverting the thus sent first target lens shape data by the thus sent amount of rotational deviation to obtain third target lens shape data, wherein the first and third target lens shape data are used as right and left target lens shape data.

6. An eyeglass frame configuration measuring device comprising:

a frame configuration measuring unit including frame configuration measuring means which measures three-dimensional configurations of two lens frames of an eyeglass frame to obtain first and second measured frame configuration data;

a program memory which stores a predetermined program therein;

a tracer arithmetic control circuit which, in accordance with said program converts said first and second measured frame configuration data to obtain third and fourth target lens shape data with respect to boxing center, respectively, mirror-inverts said third target lens shape data to obtain fifth mirror-inverted configuration data, and compares said fourth target lens shape data with said fifth mirror-inverted configuration data with respect to a corresponding boxing center to obtain an axial characteristic correction angle; and a trace data memory which stores said third target lens shape data and said axial characteristic correction angle therein.

7. An eyeglass frame configuration measuring device according to claim 6, wherein said tracer arithmetic control circuit calculates peripheral length data based on said first and second measured frame configuration data, respectively and said trace data memory stores said peripheral length data therein.

* * * * *